US007487597B2

(12) United States Patent
Diaz

(10) Patent No.: US 7,487,597 B2
(45) Date of Patent: Feb. 10, 2009

(54) METHOD AND APPARATUS FOR SUSPENDING ANCHOR BOLTS

(76) Inventor: Rudy A. Diaz, 3319 E. 10th St., #116, Long Beach, CA (US) 90804

( * ) Notice: Subject to any disclaimer, the term of this patent is extended or adjusted under 35 U.S.C. 154(b) by 31 days.

(21) Appl. No.: 11/823,324

(22) Filed: Jun. 27, 2007

(65) Prior Publication Data

US 2009/0000137 A1 Jan. 1, 2009

(51) Int. Cl.
*G01B 3/14* (2006.01)
*E04C 5/00* (2006.01)

(52) U.S. Cl. ..... 33/562; 52/295; 52/699

(58) Field of Classification Search ..... 33/562, 33/563, 613, 645; 52/295, 699
See application file for complete search history.

(56) References Cited

U.S. PATENT DOCUMENTS

| | | | | | |
|---|---|---|---|---|---|
| 3,552,734 | A * | 1/1971 | Severino et al. | ..... | 52/699 |
| 4,162,596 | A * | 7/1979 | Damman | ..... | 52/295 |
| 4,736,554 | A * | 4/1988 | Tyler | ..... | 52/295 |
| 5,050,364 | A * | 9/1991 | Johnson et al. | ..... | 52/295 |
| 5,060,436 | A * | 10/1991 | Delgado, Jr. | ..... | 52/699 |
| 5,240,224 | A * | 8/1993 | Adams | ..... | 52/699 |
| 6,105,332 | A * | 8/2000 | Boyadjian | ..... | 52/698 |
| 7,103,984 | B2 * | 9/2006 | Kastberg | ..... | 33/562 |
| 7,225,589 | B1 * | 6/2007 | Smith | ..... | 52/295 |
| 2005/0188559 | A1 * | 9/2005 | Kastberg | ..... | 33/562 |
| 2005/0284083 | A1 * | 12/2005 | Gridley et al. | ..... | 52/698 |
| 2006/0016140 | A1 * | 1/2006 | Smith | ..... | 52/295 |

* cited by examiner

*Primary Examiner*—G. Bradley Bennett
(74) *Attorney, Agent, or Firm*—Michael Bak-Boychuk

(57) ABSTRACT

A self-checking anchor bolt suspension assembly includes an array of suspension segments color coded in accordance with the size of the bolt suspending openings formed therein. The threaded shaft of the appropriate anchor bolt is inserted into the properly spaced opening and then grasped in the interior of a resilient split-tube retainer that then rests on the edges around the opening to suspend the bolt therefrom. The segments are then nailed to the concrete form and their correct color code assures the correct bolt selection.

17 Claims, 4 Drawing Sheets

FIG.-6
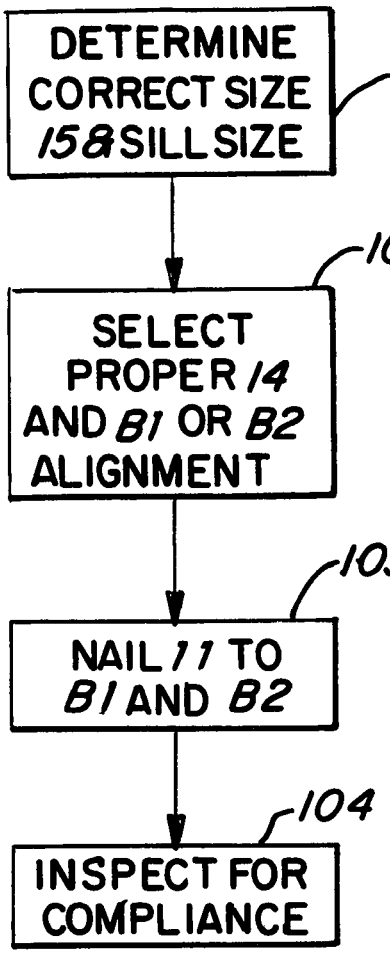
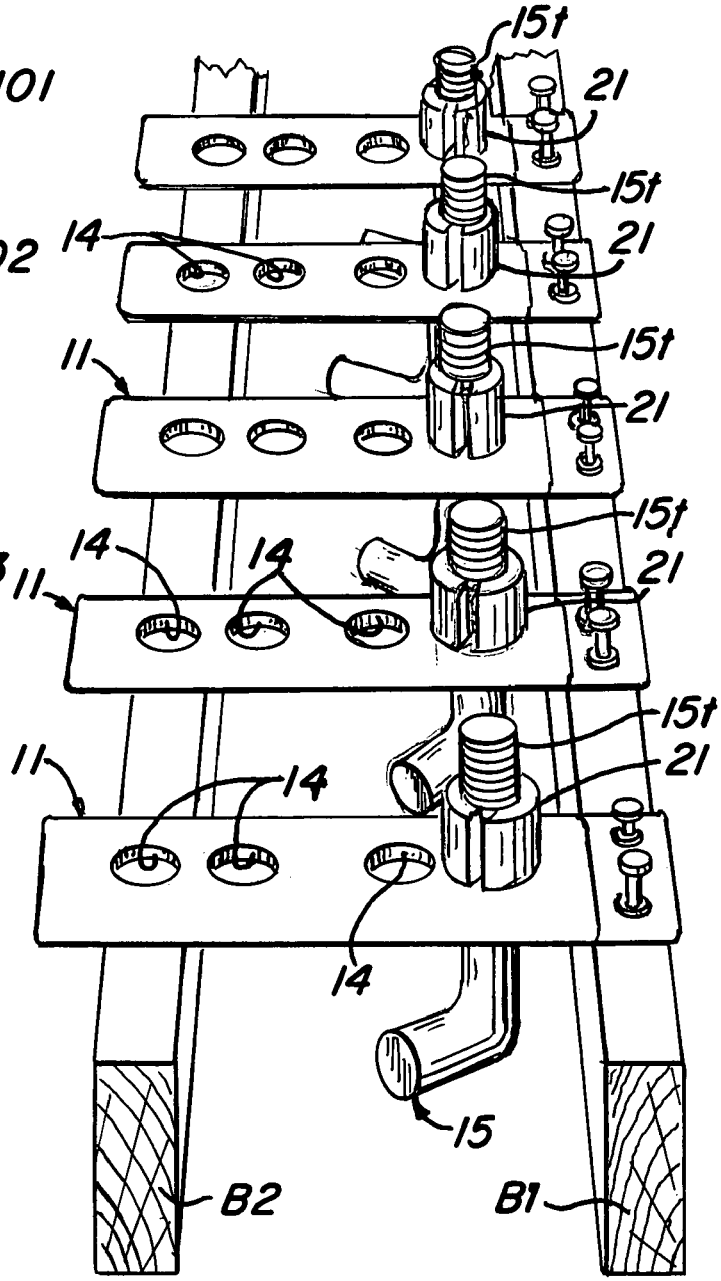
FIG.-5

METHOD AND APPARATUS FOR SUSPENDING ANCHOR BOLTS

BACKGROUND OF THE INVENTION

1. Field of the Invention

The present invention relates to concrete form framing and positioning structures, and more particularly to a method and apparatus for securing concrete forms and suspending anchor bolts therein prior to pouring concrete.

2. Description of the Prior Art

Pouring wet concrete into temporary forms that determine its eventual shape is a process that occurs with substantial frequency in the course of virtually all construction. In each instance, form integrity against distortion by the weight of the wet concrete and the correct placement retention of various anchors that are to be captured in the hardened concrete are matters of constant concern as cured concrete is absolutely unforgiving of all oversights and mistakes. These concerns over the shape and placement dimensional fidelity are therefore a subject of repeated attention from various governmental and private supervisors and inspectors.

In the past various mechanisms have been devised which in one manner or another suspend anchoring bolts between the walls of a concrete form to be thereafter immersed to the desired depths and at the desired location once the concrete is poured into the form. Examples of such suspending structures can be found in the teachings of U.S. Pat. Nos. 7,103,984 to Kastberg; 5,060,436 to Delgado, Jr.; 4,736,554 to Tyler; and others. While suitable for the purposes intended each of the foregoing describes what is essentially a positioning template for an anchor bolt devoting only a limited focus to concerns over selection and form integrity and inspection convenience.

Those prior art references that appear to attend, at least in part, to form integrity concerns, as exemplified in U.S. Pat. Nos. 5,240,224 to Adams; 7,225,589 to Smith; and also the published continuation in part thereof US 2006/0016140 fail to address the inspection convenience of the anchor bolt selections and placements before the concrete is poured. In large building projects that predominate the industry now this inattention to inspection convenience tends to raise labor costs as employees and equipment stand by to allow the inspectors to finish their job.

Those in the art will appreciate that proper attention to the inspection process has its own inherent benefits. Anticipating the arrival of an inspector will direct the focus of the construction workers to the details that are a part of the inspection check list and these same details are, of course, also the significant aspects of the quality of their work product. Anchor bolt locating mechanisms that are not only useful for their primary function but also useful in enhancing selection and form integrity while assisting the inspection process will, by these combined features, assure proper attention to this detail. A mechanism that accommodates this combination of features is therefore extensively desired and it is one such device that is disclosed herein.

SUMMARY OF THE INVENTION

Accordingly, it is the general purpose and object of the present invention to provide an anchor bolt suspending structure that is also useful to brace the concrete form, that is sized and visually identifiable in coordinated association with several anchor bolt sizes, and that is easily affixed to and removed from the concrete form.

Other objects of the invention are to provide an anchor bolt suspending combination that protects the exposed threads thereof from inadvertent coating by wet cement.

Further objects of the invention are to provide a deployment method for anchor bolts in concrete forms that by the dimensional selection of components used therein determines the appropriate anchor bolt choice and the appropriate spacing thereof from the form edges.

Yet additional objects of the invention are to provide a process for mounting anchor bolts for immersed capture in poured concrete that includes visual indications of the bolt size and its deployed spacing relative the concrete form walls while also providing bracing therefor.

Briefly, these and other objects are accomplished within the present invention by providing a plurality of generally rectangular, flat, polymeric segments each of a longitudinal dimension that is equal or greater than the customary width of a stem wall, concrete footing or other structure formed by pouring wet concrete into a form. Preferably both sides of each segment are scribed with transverse grooves, or visibly indented transverse guide marks, spaced from each other by dimension increments conforming to the customary dimensions of the sill or base piece of a framed wall. In the United States, for example, these customary framing lumber dimensions are 2 by 4 inch, 2 by 6 inch, 2 by 8 or even by 10 inch nominal, selected by the load that is to be carried by the wall, the depth needed for adequate insulation thickness that may be demanded by the local climate, potential local earthquake shear loads, and so on.

These same loading concerns also demand that the sill or base piece forming the wall be firmly anchored to the footing or slab. For these reasons anchoring bolts, sometimes referred to a J-bolts, are suspended to extend into the form before the wet concrete is poured, the spacing therebetween, their depth of immersion into the concrete and the thickness of their shanks being again determined by the loads that are to be carried therein. Since it has been well appreciated in the construction industry that the load transfer from a framed wall into the footing or foundation effected by an anchor bolt can be greatly enhanced by appropriately sized square washers or sill plates, the lateral spacing from the exterior form wall is also predetermined in coordination with the sill width and the sill plate dimensions.

To facilitate this suspension of the severally sized anchor bolts each of the polymeric segments includes a plurality of equally sized circular holes or drillings spaced along the length thereof at spacing intervals that correspond to the sill plate dimensions associated with a one or another sill or base framing piece. Preferably these spaced holes on a segment are each of one common size selected to receive with a small clearance the threaded portion of a correspondingly sized anchor bolt, with the segments then color coded in accordance with the anchor bolt size that can be suspended therein. For example, a segment that is drilled to accept anchor bolts of only a 1 and ¼ inch shank can be color coded bright yellow, a 1 inch shank may be color coded orange, a ⅞ inch shank color coded green, and so on.

A set of polymeric, resiliently deformable split tube retainers are then positioned onto the threaded portions of the anchor bolt shanks that are inserted into the appropriate openings and project above the segment, grasping the bolt shank by resilient compression against the threads formed thereon. The resulting radial dimension increased by the thickness of the mounted retainer results in dimensional interference with the opening, thus effecting a suspending dimensional interference for the received bolt. Of course, once properly positioned the resilient retainers also provide an effective shield for the bolt threads against any splashing by the poured concrete.

To insure a fool-proof bolt selection and suspension process the wall thickness of the split tube retainers is about equal to the smallest increment in bolt shank diameters. By providing a radial clearance between the appropriate bolt shank and its corresponding hole that is about one half this retainer wall thickness a resulting dimensional hierarchy is obtained where the improper hole-to-bolt shank selection is immediately revealed since a bolt shank that is too large for the hole just can not be inserted and a bolt that is too small will simply fall out even with the retainer mounted thereon.

Those skilled in the art will appreciate that an appropriate bolt selection is effectively assured by this inventive dimensional hierarchy and once the appropriate color coding of the segments is determined to comply with the local building code the correct anchoring selection is immediately revealed. Similar considerations are also obtained by the spacing of the holes relative the transverse guide marks which can be labeled in coordinated groupings as corresponding to a 2 by 4, a 2 by 6 or 2 by 8, and so on, sill. These guide marks then set the proper transverse deployment of the segment on a form wall which then also properly spaces the suspended anchor bolt from the wall edge to accommodate the correctly sized sill plate.

In this manner the inspector needs to check only the closest one of the bolt suspensions and thereafter just a generally observe for the proper color coding and similar alignment along the form edge to assure him or herself of the proper complement and position before the concrete is poured. Prior to the inspector's check this same complement also effects a self-checking process for the construction workers by the coordinated dimensional hierarchy obtained in the inventive combination. Once the coordinated details are observed the worker can then safely affix the complement to the form by driving double-headed nails through corresponding nail holes formed in each segment.

It will be appreciated that these conveniences that the invention provides are not just useful in large construction projects, but are also useful to guide a novice along the rigorous path of proper construction practice.

BRIEF DESCRIPTION OF THE DRAWINGS

FIG. 5 is a plan view of exemplary sets of suspension segments and their associated anchor bolts in accordance with the present invention; and FIG. 6 is a flow chart illustrating the sequence of steps effected in the course of use of the inventive anchor bolt positioning assembly.

DESCRIPTION OF THE PREFERRED EMBODIMENT

Figure 1:
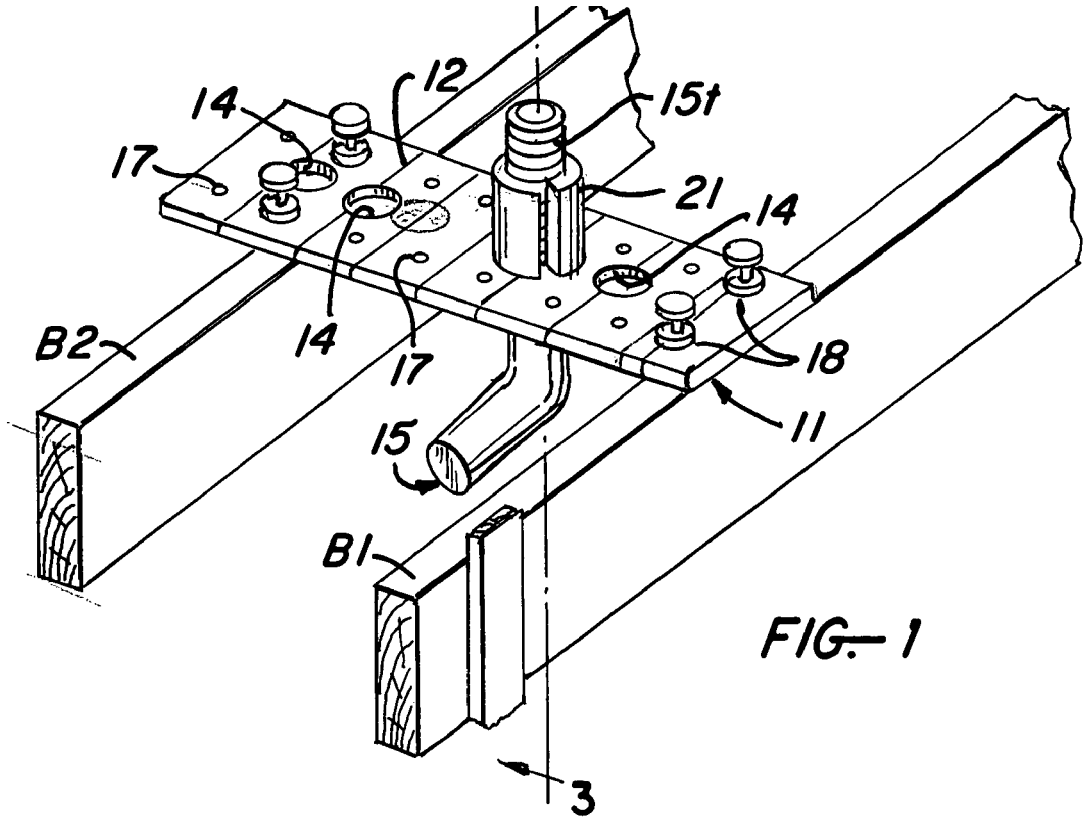
FIG. 1 is a perspective illustration of the inventive anchor bolt positioning assembly affixed to the form defining structures that confine poured concrete.
Figure 3:
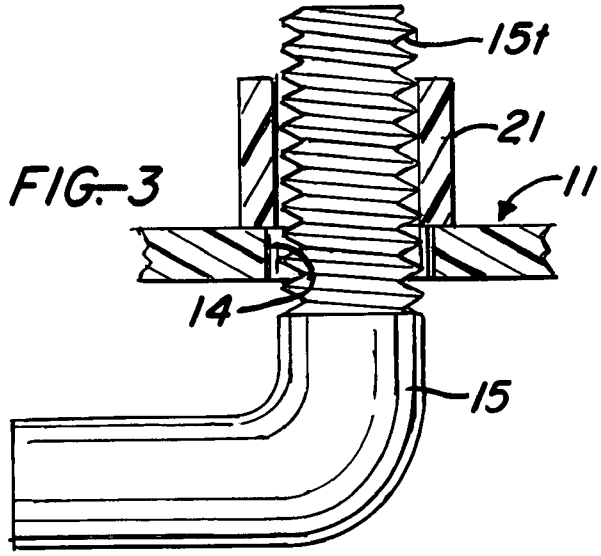
FIG. 3 is a sectional view taken along line 3-3 of FIG. 1, illustrating the inventive dimensional interrelationships that assure correct selection and positioning of anchor bolts.
Figure 2:
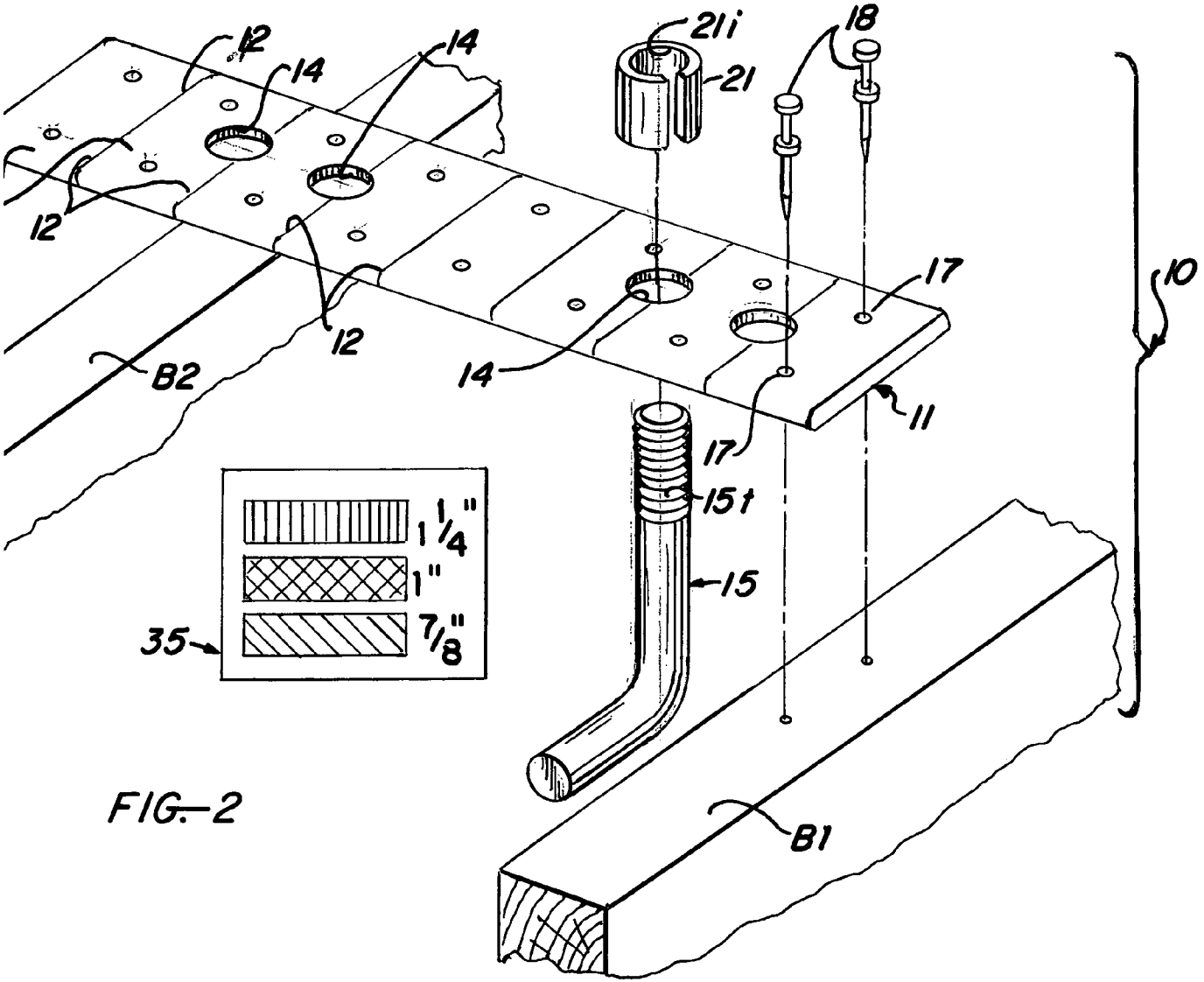
FIG. 2 is yet another perspective illustration, separated by parts, illustrating the cooperative parts and components of the inventive anchor bolt positioning assembly that when combined in accordance with the invention cooperate in a manner shown in FIG. 1.

As shown in FIGS. 1-3, the inventive anchor bolt positioning assembly, generally designated by the numeral 10, comprises a generally rectangular, elongate segment 11 marked on both sides with transversely aligned grooves or guide marks 12 and including spaced along the length thereof a set of equally sized circular openings 14. The threaded portion 15*t* of the shank or shaft of an appropriately sized anchor bolt 15, sometimes referred to as a J-bolt, is then inserted from below into a selected one of the openings 14 to extend through the plate or segment 11 a projecting portion of the shaft for capture in the interior 211 of a resilient, longitudinally split tube section or retainer 21.

Preferably, the clearance between the opening 14 and the threaded portion 15*t* of the bolt shaft is less than the wall thickness of retainer 21 and once the threaded shaft portion is resiliently captured therein a retaining engagement of the bolt in the segment 11 is effected by the resulting dimensional interference and the lower bolt end 16. Thus once the proper opening 14 for receiving an appropriately sized bolt shank 15*t* is selected an effective dimensional interlock is obtained by the engaged tube retainer 21.

Those skilled in the art will appreciate that this dimensional interlock is effective only in those instances where the bolt shaft can pass through the opening and also where the combined diameter of the bolt shaft 15*t* with the tube section 21 positioned thereon results in a dimensional interference with the periphery of opening 14. Simply, smaller diameter bolts will fall out of the opening, even when captured by the split tube section, and the shank of the oversized bolt just won't fit at all into the any one of the equally sized openings 14 of the segment 11. In this manner a coordinated interrelationship is inventively established between a particular set of segments 11 and a corresponding set of bolts 15 that is utilized to further advantage in accordance with the description following.

Figure 4:
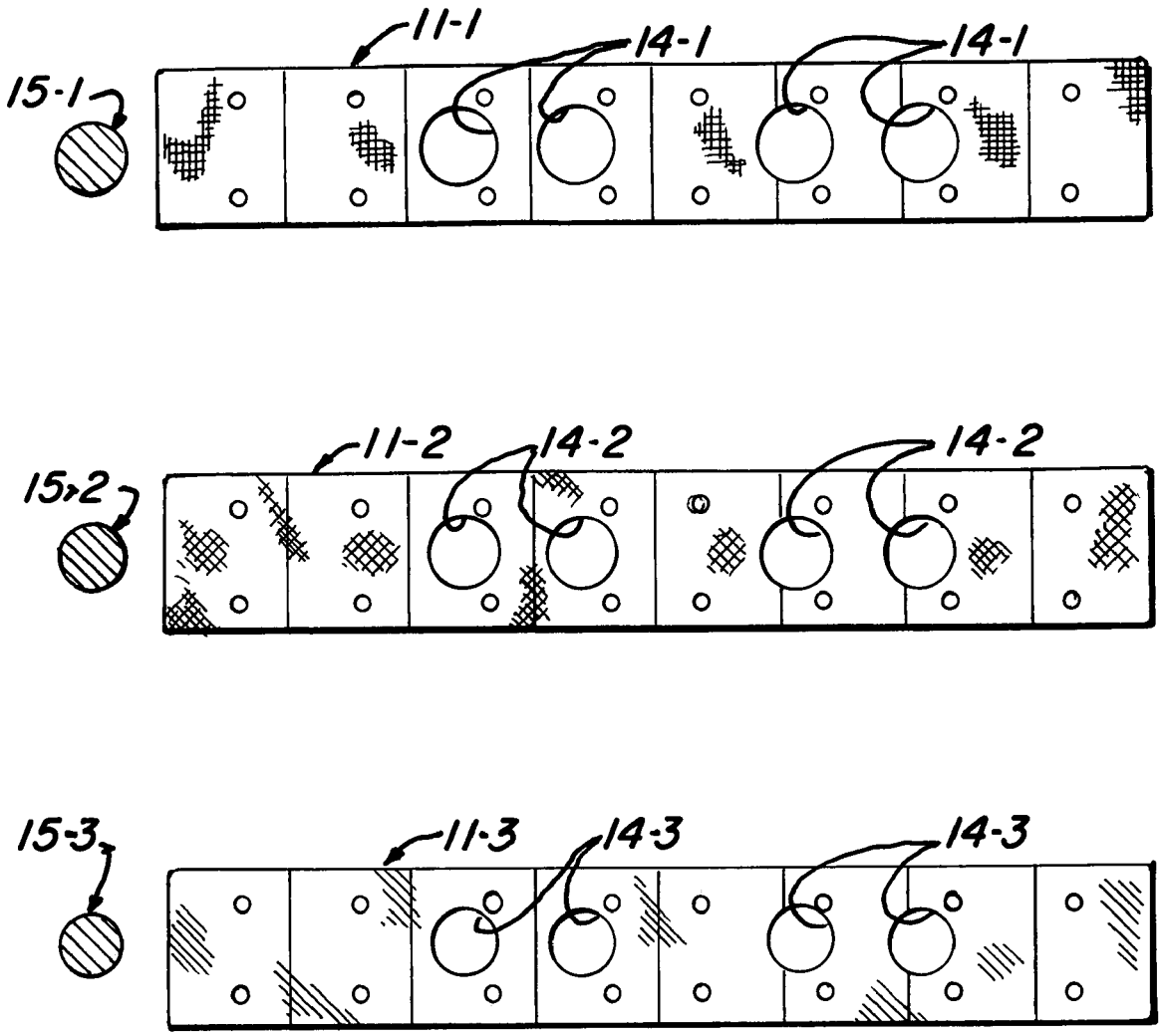
FIG. 4 is a perspective illustration of an array of the inventive positioning assemblies deployed along one linear portion of a concrete form illustrating the inspection convenience thereof.
Figure 3:
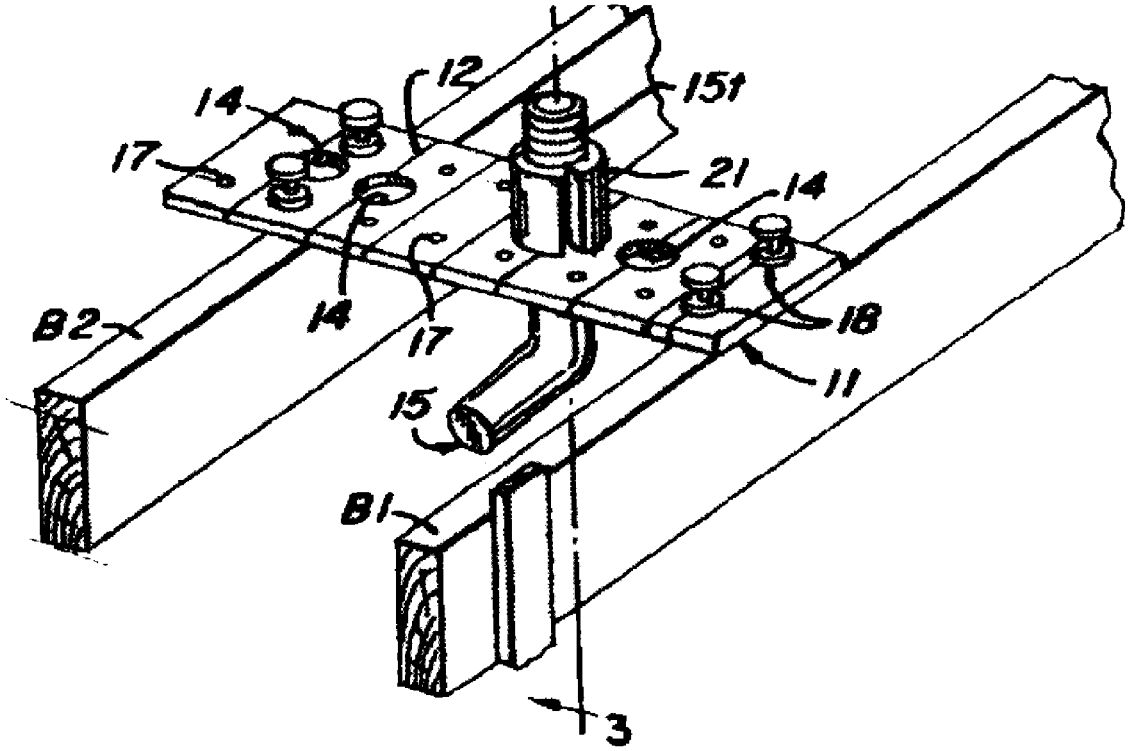
Figure 3:
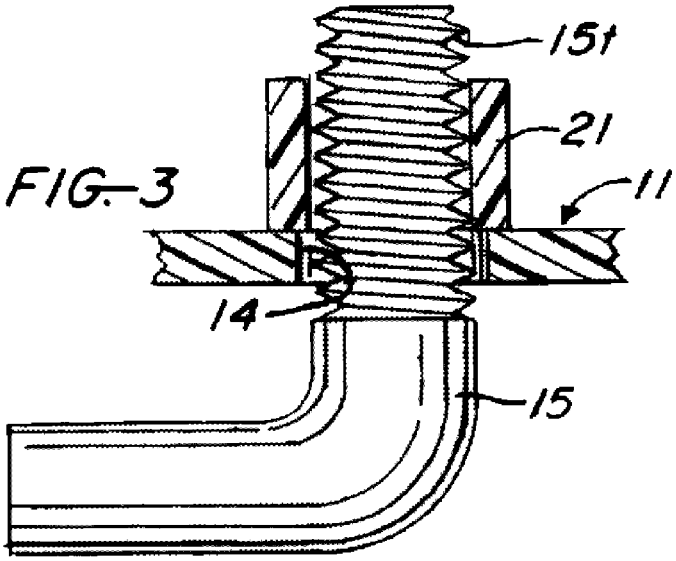

By particular reference to FIGS. 4 and 5 variously dimensioned segments 11 may be combined into a set shown as segments 11-1, 11-2, 11-3 and so on, with the correspondingly sized openings 14-1, 14-2 and 14-3 formed to match the shank diameters of the anchor bolts 15-1, 15-2 and 15-3 that is to be received therein. Thus, for example, segment 11-1 may be provided with openings 14-1 sized to receive an anchor bolt 15-1 having a 1 and ¼ inch shank diameter, i.e., openings 14-1 of about 1 and 5/16 inch diameter. All the openings 14-2 in segment 11-2, in turn, may be of a 1 and 1/16 inch diameter to receive the 1 inch shank of anchor bolt 15-2, the openings 14-3 in segment 11-3 may be sized at a $15/16^{th}$ inch diameter to receive the ⅞ inch diameter shanks of bolts 15-3, and so on.

In this manner a complementary relationship is established by this dimensional selection process where only the appropriately sized anchor bolt is retained in a corresponding segment and by distinctly coloring segments 11-1, 11-2, 11-3 and the others, e.g., yellow, orange, green and so on, a visual indication is provided that immediately informs any inspector or supervisor which anchor bolts are suspended into the form. To refresh recollection and/or assist in the comprehension of this color coding a legend card 35 may be provided to the inspecting or managing personnel with the color coding explained thereon.

Those skilled in the construction business have long appreciated the convenience of standardized dimensional increments of available building materials. Simply, the needs of regional commerce require that only a limited variety of construction items be stored in inventory to avoid exorbitant storage costs and this variety differs from one part of the world to another. Recognizing these various dimensional conventions practiced throughout the world, no limitation is intended by the choice of the dimensional practices here in the United States in the description herein, the reference to such standardized dimensional increments being solely to effect a cogent explanation of the instant invention.

The current construction practice in the US utilizes construction lumber in standardized 2 inch dimensional increments with a 12 inch width considered as a practical limit in the width of sawed lumber. Conforming to these practices, each of the segments 11-1, 11-2, 11-3, and so on, are preferably of a 16 inch length with the transverse guide marks 12 spaced in equal 2 inch increments on both sides thereof, each interval between the guide marks also including a pair of laterally spaced nail holes 17 through which double-headed nails 18 are passed to attach the segment in a spanning attachment joining the lateral boards B1 and B2 of the concrete form. Of course, the 2 inch spaced guide marks 12 are then useful in aligning this generally orthogonal attachment relative the form boards B1 and B2 that are also the conventional 2 inch lumber stock.

To conform with these same dimensional conventions the openings 14 are spaced from the ends of the segment 11 by increment groupings that each include the 2 inch overlap over the form boards B1 or B2 and also one half of the true dimension of standard construction lumber. Thus, for example, two of the openings 14 may be spaced from a first end 13*f* of segment 11 by 4.75 and 6.75 inches corresponding to nominal base or sill lumber widths of 6 or 10 inches while a second set of openings 14 may be spaced from the second end 13*s* by 3.75 and 5.75 inches corresponding to 4 and 8 inch sill lumber. Each of the openings thus spaced can then be appropriately marked by markings MM corresponding to these base plate dimensions.

In this manner all the variables of anchor bolt placement are fully imbedded into the structure itself of the locating piece, i.e., the respective segment 11. When properly effected visual inspection is greatly simplified by simply examining the locating details of one anchor bolt in a row of anchor bolts and thereafter observing from a distance the relative shank alignments of the rest, the color code of each segment, and the other observables that indelibly ascertain correct structural connections before the concrete is poured. Moreover, by selecting polymeric material structures like Nylon for the respective segments 11 and the split tube retainers 21 any unwanted concrete that may harden thereon is easily removed thus allowing conservation benefits obtained by the repeated use thereof.

It will be appreciated by those skilled in the art that the foregoing complementing combination is particularly effective in assuring proper construction practices by the working personnel, as illustrated in the sequence shown in FIG. 6. Before even reaching for these cooperating parts the worker, in step 101, must first determine the correct size of the bolt 15 and the correct dimension of the sill or base. Once this is determined the worker, in step 102, selects the properly spaced opening 14 and thus the lateral spacing of the bolt from the outer form board B1 or B2 and suspends the bolt therein by the retaining section 21. In step 103 the worker then nails the segments across the form boards while observing dimensional similarities. Then right prior to pouring the wet concrete into the form the assembly is inspected in step 104.

In this manner a simple, reliable and inexpensive array of cooperative elements assures compliance with the various building codes while also assuring an increased level of care to the several necessary details that must be observed before the unforgiving period during which the poured concrete sets up.

Obviously many modifications and variations of the instant invention can be effected without departing from the spirit of the teachings herein. It is therefore intended that the scope of the invention be determined solely by the claims appended hereto.

The invention claimed is:

1. An assembly useful in suspending anchor bolts into concrete form structures for immersion of portions thereof into concrete poured therein, comprising:

an anchor bolt including a shank provided with threads over a portion thereof;

a generally elongate planar segment having a longitudinal dimension at least equal to the span across said concrete form structure for forming a bridging suspension thereacross, said segment including a plurality of longitudinally spaced openings of generally equal size each conformed to receive the threaded portion of said shank; and a resilient retainer conformed as a tubular section split along the length thereof to receive in compressive engagement said threaded portion of said shank.

2. An assembly according to claim 1, wherein:

said anchor bolt is selected from a group of anchor bolts comprising a plurality of transverse dimensions of said threaded portions thereof; and said segment is selected from a group of segments having said openings therein sized to receive said threaded portions of the corresponding ones of said bolts.

3. An assembly according to claim 2, wherein:

each said segment in said group of segments having the openings thereof sized to receive anchor bolts of one transverse dimension is marked distinctively from said other segments in said group of segments.

4. An assembly according to claim 3, wherein:

the transverse dimension of said threaded portions of one of said anchor bolts in said group of anchor bolts differs from the transverse dimension of said threaded portion of the other ones of said bolts in said group of anchor bolts by a predetermined dimensional increment; and the tubular section of said retainer includes a wall of a thickness greater than said dimensional increment.

5. An assembly according to claim 1, further comprising:

fastening means for securing said segment to said form structure in said bridging suspension alignment thereacross.

6. An assembly according to claim 5, wherein:

said anchor bolt is selected from a group of anchor bolts comprising a plurality of transverse dimensions of said threaded portions thereof; and said segment is selected from a group of segments having said openings therein sized to receive said threaded portions of the corresponding ones of said bolts.

7. An assembly according to claim 6, wherein:

the transverse dimension of said threaded portions of one of said anchor bolts in said group of anchor bolts differs from the transverse dimension of said threaded portion of the other ones of said bolts in said group of anchor bolts by a predetermined dimensional increment; and the tubular section of said retainer includes a wall of a thickness greater than said dimensional increment.

8. An assembly according to claim 7, wherein:

each said segment in said group of segments having the openings thereof sized to receive anchor bolts of one transverse dimension is marked distinctively from said other segments in said group of segments.

9. An assembly useful in suspending anchor bolts into concrete form structures for immersion of portions thereof into concrete poured therein, comprising:

an anchor bolt including a shank provided with threads over a portion thereof;

a generally elongate planar segment having a longitudinal dimension at least equal to the span across said concrete form structure and including a plurality of longitudinally spaced openings of generally equal size each conformed to receive the threaded portion of said shank;

fastening means for securing said segment to said form structure in a spanning alignment thereacross; and a resilient retainer conformed as a tubular section split along the length thereof to receive in compressive engagement said threaded portion of said shank.

10. An assembly according to claim 9, wherein:

said anchor bolt is selected from a group of anchor bolts comprising a plurality of transverse dimensions of said threaded portions thereof; and said segment is selected from a group of segments having said openings therein sized to receive said threaded portions of the corresponding ones of said bolts.

11. An assembly according to claim 10, wherein:

the transverse dimension of said threaded portions of one of said anchor bolts in said group of anchor bolts differs from the transverse dimension of said threaded portion of the other ones of said bolts in said group of anchor bolts by a predetermined dimensional increment; and the tubular section of said retainer includes a wall of a thickness greater than said dimensional increment.

12. An assembly according to claim 11, wherein:

each said segment in said group of segments having the openings thereof sized to receive anchor bolts of one transverse dimension is marked distinctively from said other segments in said group of segments.

13. An assembly according to claim 12 wherein:

each said segment includes dimensional increment markings on the surfaces thereof generally equal to the dimensional increment of said form structure.

14. An assembly according to claim 13, wherein said fastening means includes:

nail holes formed between the adjacent ones of said dimensional markings; and double-headed nails inserted into selected ones of said nail holes in alignment with portions of said concrete form structure.

15. A method for suspending anchor bolts into concrete form structures for immersion of portions thereof into concrete poured therein, comprising the steps of:

determining the appropriate size and position relative said form structure of said anchor bolts from a set of construction requirements;

selecting from a predetermined group of variously sized anchor bolts the anchor bolt that conforms with the appropriate size that was determined;

matching from a preselected group of anchor bolt suspending segments each provided with equally sized openings spaced thereon, the openings in one segment being different in size than the openings in the other segments in the group of segments, the segment having openings in which said selected bolt is receivable; and suspending said selected bolt from an opening in said matched segment corresponding with the position determined.

16. A method according to claim 15, wherein said step of matching further comprises:

observing the visual markings on the segment in which said selected anchor bolt is receivable.

17. A method according to claim 16 comprising the further step of:

inspecting the segments positioned on said concrete form in accordance with the visual markings thereon.

* * * * *

UNITED STATES PATENT AND TRADEMARK OFFICE

CERTIFICATE OF CORRECTION

PATENT NO. : 7,487,597 B2
APPLICATION NO. : 11/823324
DATED : February 10, 2009
INVENTOR(S) : Rudy A. Diaz It is certified that error appears in the above-identified patent and that said Letters Patent is hereby corrected as shown below:

Title page should be deleted and substitute therefor the attached title page.

Signed and Sealed this

Twentieth Day of October, 2009

David J. Kappos

David J. Kappos
*Director of the United States Patent and Trademark Office*

(12) United States Patent
Diaz

(10) Patent No.: US 7,487,597 B2
(45) Date of Patent: Feb. 10, 2009

(54) METHOD AND APPARATUS FOR SUSPENDING ANCHOR BOLTS

(76) Inventor: Rudy A. Diaz, 3319 E. 10th St., #116, Long Beach, CA (US) 90804

( * ) Notice: Subject to any disclaimer, the term of this patent is extended or adjusted under 35 U.S.C. 154(b) by 31 days.

(21) Appl. No.: 11/823,324

(22) Filed: Jun. 27, 2007

(65) Prior Publication Data

US 2009/0000137 A1 Jan. 1, 2009

(51) Int. Cl.
*G01B 3/14* (2006.01)
*E04C 5/00* (2006.01)

(52) U.S. Cl. ..... 33/562; 52/295; 52/699

(58) Field of Classification Search ..... 33/562, 33/563, 613, 645; 52/295, 699
See application file for complete search history.

(56) References Cited

U.S. PATENT DOCUMENTS

| | | | | | |
|---|---|---|---|---|---|
| 3,552,734 | A * | 1/1971 | Severino et al. | ..... | 52/699 |
| 4,162,596 | A * | 7/1979 | Damman | ..... | 52/295 |
| 4,736,554 | A * | 4/1988 | Tyler | ..... | 52/295 |
| 5,050,364 | A * | 9/1991 | Johnson et al. | ..... | 52/295 |
| 5,060,436 | A * | 10/1991 | Delgado, Jr. | ..... | 52/699 |
| 5,240,224 | A * | 8/1993 | Adams | ..... | 52/699 |
| 6,105,332 | A * | 8/2000 | Boyadjian | ..... | 52/698 |
| 7,103,984 | B2 * | 9/2006 | Kastberg | ..... | 33/562 |
| 7,225,589 | B1 * | 6/2007 | Smith | ..... | 52/295 |
| 2005/0188559 | A1 * | 9/2005 | Kastberg | ..... | 33/562 |
| 2005/0284083 | A1 * | 12/2005 | Gridley et al. | ..... | 52/698 |
| 2006/0016140 | A1 * | 1/2006 | Smith | ..... | 52/295 |

* cited by examiner

*Primary Examiner*—G. Bradley Bennett
(74) *Attorney, Agent, or Firm*—Michael Bak-Boychuk

(57) ABSTRACT

A self-checking anchor bolt suspension assembly includes an array of suspension segments color coded in accordance with the size of the bolt suspending openings formed therein. The threaded shaft of the appropriate anchor bolt is inserted into the properly spaced opening and then grasped in the interior of a resilient split-tube retainer that then rests on the edges around the opening to suspend the bolt therefrom. The segments are then nailed to the concrete form and their correct color code assures the correct bolt selection.

17 Claims, 4 Drawing Sheets

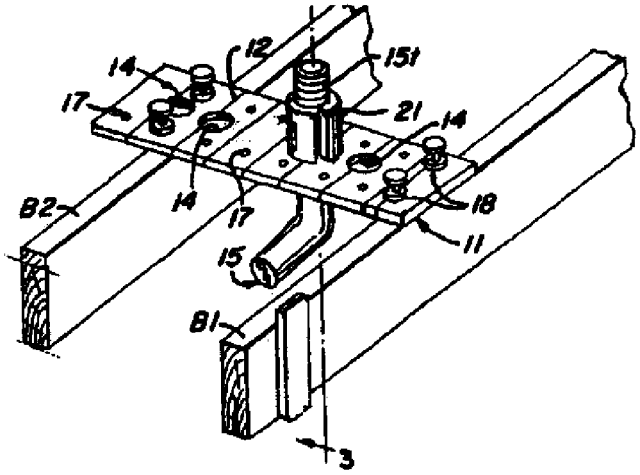

UNITED STATES PATENT AND TRADEMARK OFFICE

CERTIFICATE OF CORRECTION

PATENT NO. : 7,487,597 B2
APPLICATION NO. : 11/823324
DATED : February 10, 2009
INVENTOR(S) : Rudy A. Diaz It is certified that error appears in the above-identified patent and that said Letters Patent is hereby corrected as shown below:

Title page should be deleted and substitute therefor the attached title page.

Delete Drawing Sheet 1 of 4 and substitute therefor the attached Drawing Sheet 1 of 4.

This certificate supersedes the Certificate of Correction issued October 20, 2009.

Signed and Sealed this

Tenth Day of November, 2009

David J. Kappos

David J. Kappos
*Director of the United States Patent and Trademark Office*

(12) United States Patent
Diaz

(10) Patent No.: US 7,487,597 B2
(45) Date of Patent: Feb. 10, 2009

(54) METHOD AND APPARATUS FOR SUSPENDING ANCHOR BOLTS

(76) Inventor: Rudy A. Diaz, 3319 E. 10th St., #116, Long Beach, CA (US) 90804

( * ) Notice: Subject to any disclaimer, the term of this patent is extended or adjusted under 35 U.S.C. 154(b) by 31 days.

(21) Appl. No.: 11/823,324

(22) Filed: Jun. 27, 2007

(65) Prior Publication Data

US 2009/0000137 A1 Jan. 1, 2009

(51) Int. Cl.
*G01B 3/14* (2006.01)
*E04C 5/00* (2006.01)

(52) U.S. Cl. ..... 33/562; 52/295; 52/699

(58) Field of Classification Search ..... 33/562, 33/563, 613, 645; 52/295, 699
See application file for complete search history.

(56) References Cited

U.S. PATENT DOCUMENTS

| | | | | | |
|---|---|---|---|---|---|
| 3,552,734 | A * | 1/1971 | Severino et al. | ..... | 52/699 |
| 4,162,596 | A * | 7/1979 | Damman | ..... | 52/295 |
| 4,736,554 | A * | 4/1988 | Tyler | ..... | 52/295 |
| 5,050,364 | A * | 9/1991 | Johnson et al. | ..... | 52/295 |
| 5,060,436 | A * | 10/1991 | Delgado, Jr. | ..... | 52/699 |
| 5,240,224 | A * | 8/1993 | Adams | ..... | 52/699 |
| 6,105,332 | A * | 8/2000 | Boyadjian | ..... | 52/698 |
| 7,103,984 | B2 * | 9/2006 | Kastberg | ..... | 33/562 |
| 7,225,589 | B1 * | 6/2007 | Smith | ..... | 52/295 |
| 2005/0188559 | A1 * | 9/2005 | Kastberg | ..... | 33/562 |
| 2005/0284083 | A1 * | 12/2005 | Gridley et al. | ..... | 52/698 |
| 2006/0016140 | A1 * | 1/2006 | Smith | ..... | 52/295 |

* cited by examiner

*Primary Examiner*—G. Bradley Bennett
(74) *Attorney, Agent, or Firm*—Michael Bak-Boychuk

(57) ABSTRACT

A self-checking anchor bolt suspension assembly includes an array of suspension segments color coded in accordance with the size of the bolt suspending openings formed therein. The threaded shaft of the appropriate anchor bolt is inserted into the properly spaced opening and then grasped in the interior of a resilient split-tube retainer that then rests on the edges around the opening to suspend the bolt therefrom. The segments are then nailed to the concrete form and their correct color code assures the correct bolt selection.

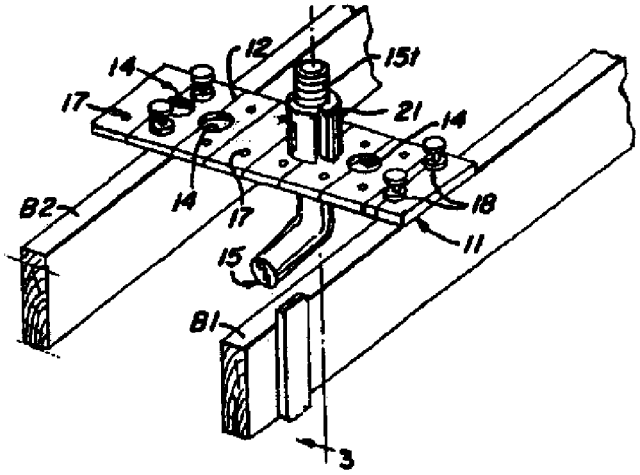

17 Claims, 4 Drawing Sheets